US006009853A

United States Patent [19]

Fujikawa et al.

[11] Patent Number: 6,009,853

[45] Date of Patent: Jan. 4, 2000

[54] THROTTLE CONTROL APPARATUS

[75] Inventors: Toru Fujikawa, Obu; Futoshi Kushigemachi, Kariya; Masaru Shimizu, Toyota; Hirotaka Kurita, Nagoya, all of Japan

[73] Assignee: Aisin Seiki Kabushiki Kaisha, Kariya, Japan

[21] Appl. No.: 08/975,707

[22] Filed: Nov. 21, 1997

[30] Foreign Application Priority Data

Nov. 21, 1996 [JP] Japan ..... 8-310918

[51] Int. Cl.[7] ..... F02D 43/04

[52] U.S. Cl. ..... 123/396; 123/397; 123/398; 123/399; 123/481

[58] Field of Search ..... 123/396, 397, 123/398, 399, 481, 198 F

[56] References Cited

U.S. PATENT DOCUMENTS

| | | | |
|---|---|---|---|
| 5,429,090 | 7/1995 | Kotchi et al. | 123/396 |
| 5,431,139 | 7/1995 | Grutter et al. | 123/399 |
| 5,435,284 | 7/1995 | Shimizu et al. | 123/396 |
| 5,447,133 | 9/1995 | Kamio et al. | 123/399 |
| 5,492,097 | 2/1996 | Byram et al. | 123/396 |
| 5,524,589 | 6/1996 | Kikkawa et al. | 123/396 |
| 5,623,906 | 4/1997 | Storkhok | 123/399 |
| 5,755,201 | 5/1998 | Knoss et al. | 123/396 |
| 5,778,853 | 7/1998 | Saito | 123/396 |
| 5,829,409 | 11/1998 | Saito et al. | 123/396 |

FOREIGN PATENT DOCUMENTS

| | | |
|---|---|---|
| 55-145867 | 11/1980 | Japan . |
| 60-81241 | 6/1985 | Japan . |

*Primary Examiner*—Erick R. Solis
*Attorney, Agent, or Firm*—Burns, Doane, Swecker & Mathis, L.L.P.

[57] ABSTRACT

A throttle control apparatus that maintains a vehicle's ability to run during a throttle system failure includes a throttle-controlling ECU that calculates a throttle opening instruction value from an accelerator stroke signal outputted from an accelerator pedal sensor, and supplies a motor with a current value based on the instruction value, to control the opening of a throttle valve. If the deviation between the instruction value and the output value from a throttle sensor is greater than a reference value, the ECU determines that there is a system failure. If it is determined that a system failure exists, an internal combustion engine controlling ECU varies the number of cylinders of the engine in operation to vary the engine output, depending on whether the amount of depression of the accelerator pedal by the driver is greater than a predetermined value.

17 Claims, 6 Drawing Sheets

THROTTLE CONTROL APPARATUS

FIELD OF THE INVENTION

The present invention generally relates to a throttle control apparatus. More particularly, the present invention pertains to a throttle control apparatus for a vehicle engine that controls the opening of a throttle valve by driving a motor in accordance with the amount of depression of an accelerator pedal.

BACKGROUND OF THE INVENTION

Engine throttle control apparatus that control the opening of a throttle valve by driving a throttle valve motor in accordance with the amount by which an accelerator pedal is depressed are known. In a conventional throttle control apparatus, a throttle valve motor is supplied with current in accordance with a signal from an accelerator sensor which detects the accelerator pedal stroke corresponding to the amount of depression of the accelerator pedal. The motor is correspondingly driven to operate the throttle valve to thereby control the intake air flow.

To eliminate deviation between the signal from a throttle sensor which detects the throttle opening of the throttle valve and the signal from the accelerator sensor, feedback control of the motor is performed based on proportional-integral-derivative control (PID control), Japanese Utility Model Laid-Open No. Sho 60-81241 discloses a throttle valve opening maintaining mechanism for maintaining a throttle valve opening that enables a preset low running speed of a vehicle when the accelerator pedal is in a released state, and a control circuit for controlling the throttle valve opening maintaining mechanism. When a system abnormality is determined, the output of current to the throttle valve motor is discontinued and the opening maintaining mechanism is operated.

The system disclosed in Japanese Utility Model Laid-Open No. Sho 60-81241 enables escape driving at the time of a throttle valve failure by setting a predetermined throttle valve opening. However, because this conventional control method fixes the throttle valve to the predetermined opening at the time of a system failure, problems associated with an inappropriate throttle opening arise. For example, if the predetermined opening is the throttle valve opening needed to maintain a vehicle speed on highways or the like, the predetermined throttle valve opening is excessively great on ordinary (i.e., non-highway) roads. Conversely, if the predetermined throttle valve opening is reduced, it is likely that continued vehicle operation and movement will be quite difficult if not impossible on an uphill road or in other road conditions.

SUMMARY OF THE INVENTION

Accordingly, a need exists for a throttle control apparatus that avoids vehicle stall even if a throttle system failure occurs and enables escape driving in accordance with the driver's intention during such a failure.

According to the present invention, a throttle control apparatus includes a throttle valve for regulating air flow in an intake passage of an internal combustion engine, and a throttle control device for controlling opening of the throttle valve by driving a motor in accordance with a predetermined instruction value based on various information. A throttle sensor is provided for detecting an opening of the throttle valve and a determination device determines whether there exists a system abnormality by comparing the deviation between the predetermined instruction value and a value output from the throttle sensor with a preset reference value. A valve opening fixation mechanism fixes the opening of the throttle valve at a predetermined opening if the determination device determines the existence of a system abnormality. An output adjustment device varies the output of the internal combustion engine while the opening of the throttle valve is fixed.

The motor is driven in accordance with an electric current value determined as a throttle opening instruction value computed by the throttle control device on the basis of various information. If the deviation between the predetermined instruction value and the value of the output from the throttle sensor exceeds the preset reference value, the determination device determines that a system abnormality has occurred. Subsequently, the valve opening fixation mechanism fixes the throttle valve opening at a predetermined value, and the output adjustment device varies the output of the internal combustion engine. Therefore, even if a throttle system failure occurs, the throttle control apparatus does not cause the vehicle to stop but enables driving that reflects driver's intention during the failure.

The various information may include a signal based on an amount of depression of the accelerator pedal, a signal based on operation of a brake pedal and a signal based on a preset condition. The control device calculates the predetermined instruction value based on not only the signal indicating the amount of depression of the accelerator pedal or the signal indicating operation of the brake pedal, but also a signal based on a preset condition, such as a signal from a cruise control. Therefore, the throttle control apparatus is applicable to various systems including those not associated with the amount of depression of the accelerator pedal or operation of the brake pedal.

The output adjustment device can vary the number of cylinders that are operational during operation of the internal combustion engine, on the basis of the various information. The output of an internal combustion engine can thereby be varied on the basis of a signal indicating the amount of depression of the accelerator pedal, even during a throttle system failure. Therefore, the throttle control apparatus enables escape driving that reflects a driver's intention.

According to another aspect of the invention, a throttle control apparatus includes a throttle valve that is adapted to regulate air flow in the intake passage of an internal combustion engine, a motor connected to the throttle valve for opening the throttle valve, and a throttle control device for controlling opening of the throttle valve through operation of the motor. A determination device is adapted to determine whether there exists an abnormality in the throttle valve, and a valve opening fixation mechanism fixes the throttle valve at a predetermined opening when the determination device determines the existence of an abnormality in the throttle valve. In addition, an output adjustment device varies the output of the internal combustion engine when the determination device determines the existence of an abnormality in the throttle valve and when the opening of the throttle valve is fixed by the valve opening fixation mechanism.

According to another aspect of the invention, a throttle control apparatus includes a throttle valve device which regulates air flow in an intake passage of an internal combustion engine, a motor connected to the throttle valve for opening the throttle valve, and a determination device which determines whether there exists an abnormality in the throttle valve device. A throttle control unit is connected to the motor and the determination device for stopping operation of the motor when the determination device determines there is an abnormality in the throttle valve, and a valve opening fixation mechanism fixes the throttle valve at a predetermined open position when the throttle control unit stops operation of the motor due to a determination by the determination means that there is an abnormality in the throttle valve. An engine control unit is designed to vary the output of the internal combustion engine when the determination device determines the existence of an abnormality in the throttle valve and when the opening of the throttle valve is fixed at the predetermined position by the valve opening fixation mechanism.

BRIEF DESCRIPTION OF THE DRAWING FIGURES

The foregoing and other features of the present invention will become apparent from the following detailed description considered with reference to the accompanying drawing figures, in which like element are designated by like reference numerals and wherein.

Figure 5:
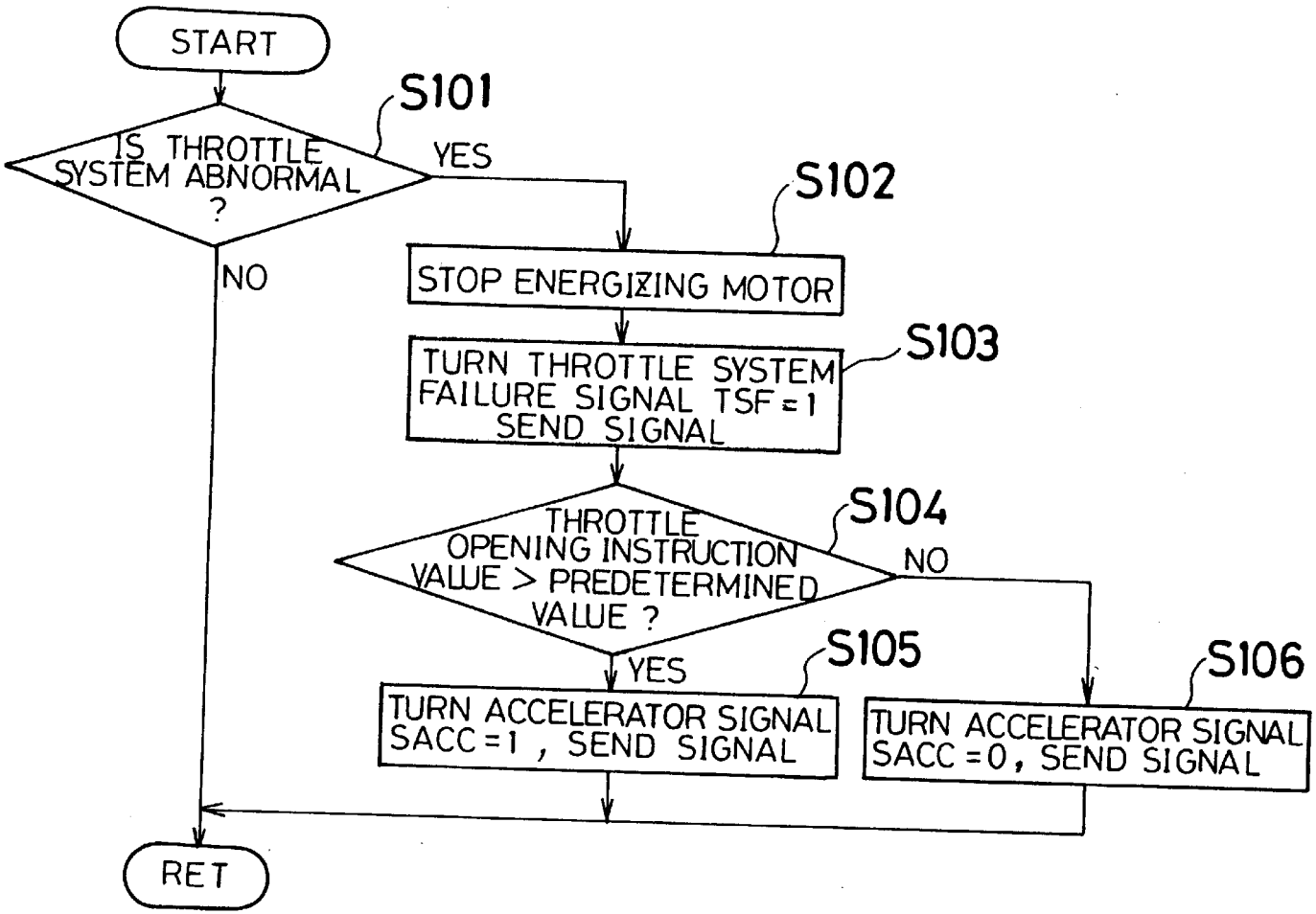
Figure 6:
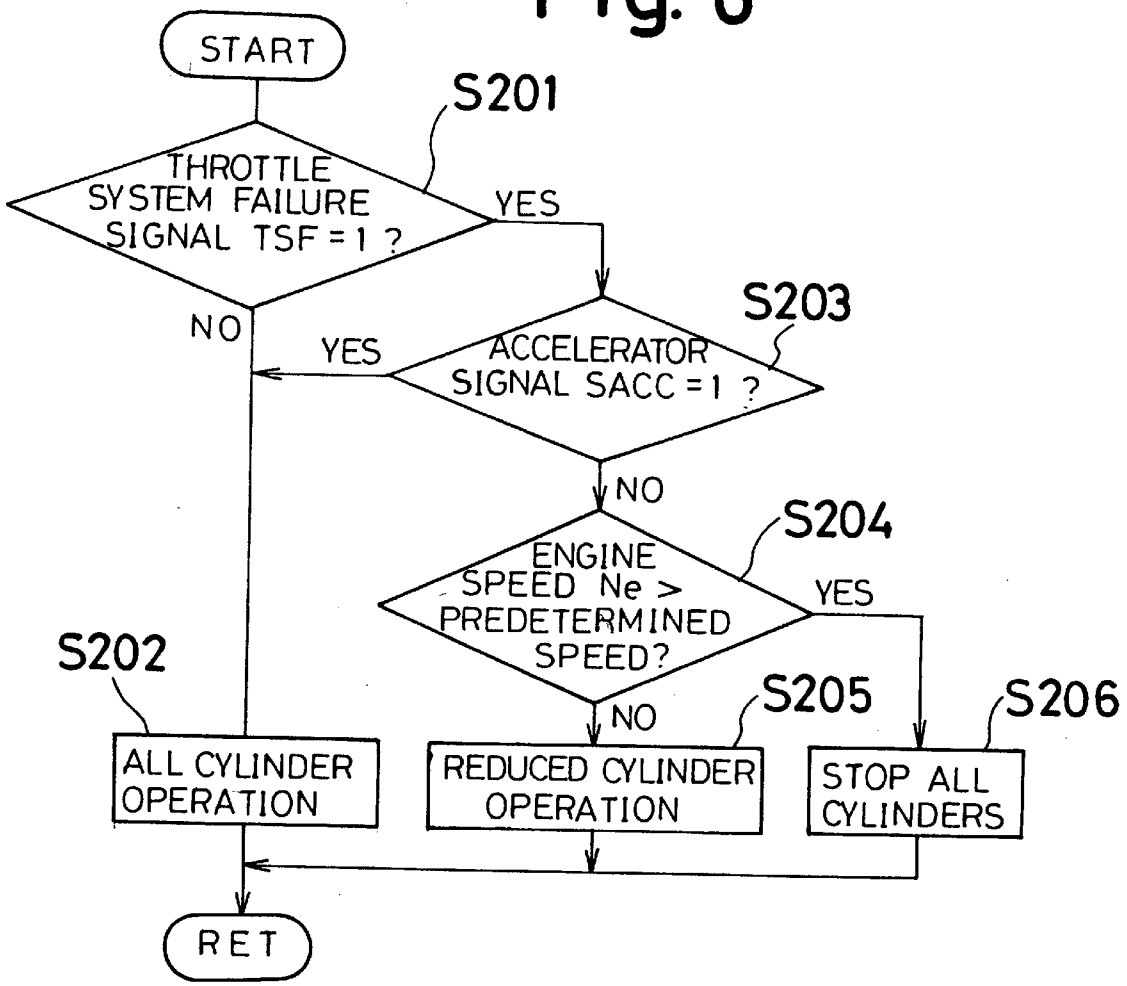

FIG. 5 is a flowchart illustrating a processing procedure of the CPU provided in the throttle-controlling ECU forming a part of the throttle control apparatus according to the present invention; and FIG. 6 is a flowchart illustrating another processing procedure of the CPU provided in the internal combustion engine-controlling ECU used in the throttle control apparatus according to the present invention.

DETAILED DESCRIPTION OF A PREFERRED EMBODIMENT

Referring to FIGS. 1–4, the throttle control apparatus according to the present invention includes a throttle body 10 formed of aluminum or similar material for purposes of weight reduction and enhancing heat releasing characteristics. The throttle body 10 is mounted on an intake manifold (not specifically shown) of an internal combustion engine using four mount holes 10*a* formed in the throttle body 10.

A disc-shaped throttle valve 11 is disposed in an intake air passage 10*b* defined in the throttle body 10. The throttle valve 11 is positioned in and extends through a slit 12*a* formed in a throttle shaft 12. The throttle valve 11 is rigidly connected to the throttle shaft 12 by two screws 13. The throttle shaft 12 is rotatable supported at opposite end portions close to the peripheral edge portions of the throttle valve 11 by bearings 14, 15 disposed in the throttle body 10. The right-side end portion of the throttle shaft 12 as seen with reference to FIG. 2, is rigidly connected with a sector gear 16 that is rotatably fixed in position.

Figure 1:
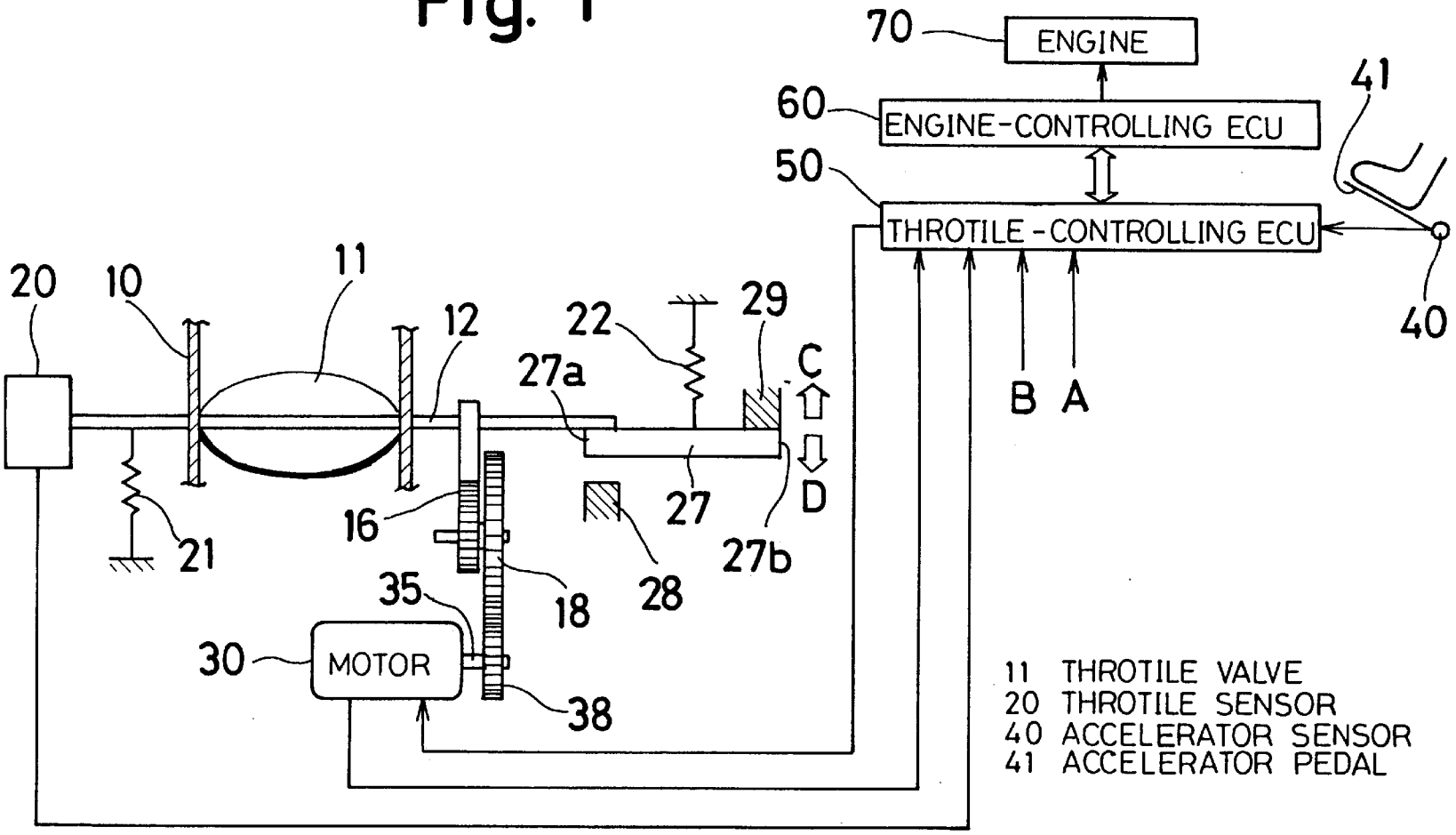
FIG. 1 is a schematic diagram illustrating the overall construction of the throttle control apparatus of the present invention.
Figure 2:
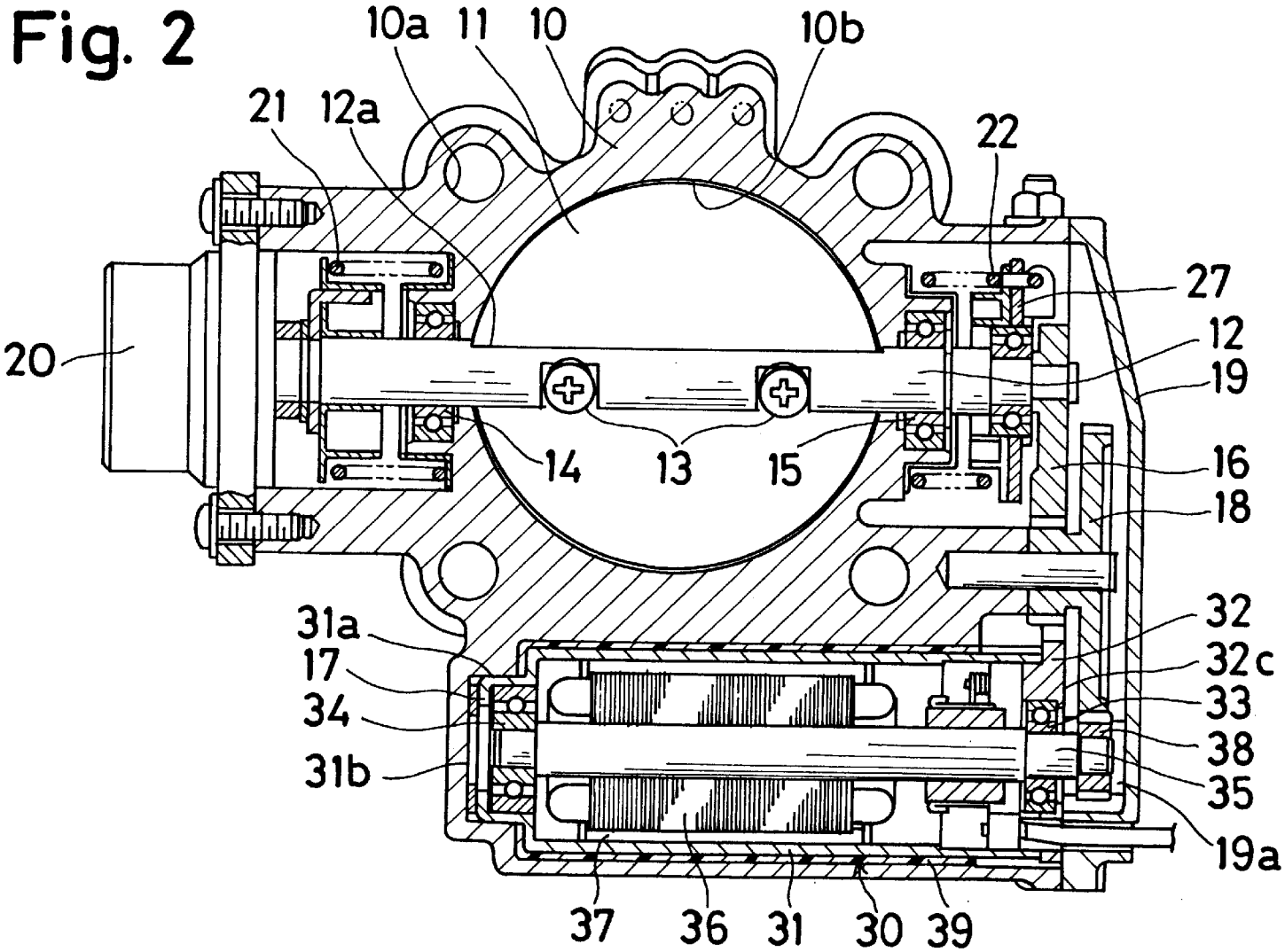
FIG. 2 is a sectional view of the throttle control apparatus shown in FIG. 1, illustrating the mechanical construction thereof.

A known throttle sensor 20 for detecting the throttle opening of the throttle valve 11 is fixed by screws to a left-side end surface of the throttle body 10 as seen with reference to FIG. 2. The throttle sensor 20 is disposed coaxially with the throttle shaft 12. A return spring 21 in the form of a torsion spring constantly applies a force to the throttle valve 11 to urge it in a closing direction (i.e., in the direction D shown in FIG. 1). An opener spring 22 in the form of a torsion spring constantly applies a force to the throttle valve 11 by way of an intermediate lever 27 to urge the throttle valve 11 in the opening direction (i.e., in the direction C shown in FIG. 1). The force from the opener spring 22 is designed to exceed the force of the return spring 21.

Figure 3:
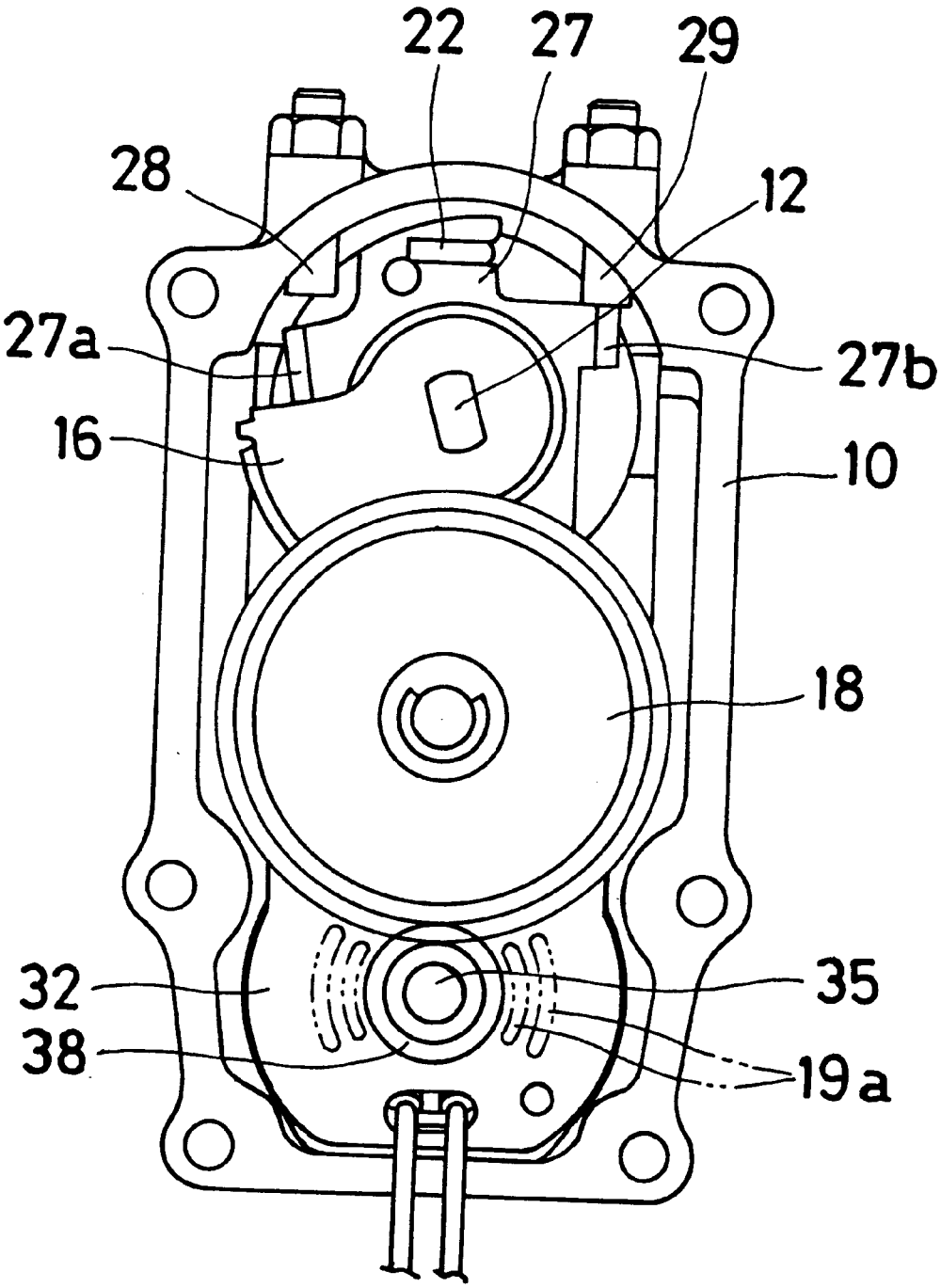
FIG. 3 is a right side view of the apparatus shown in FIG. 2 in which the throttle body cover is removed from the throttle body.
Figure 4:
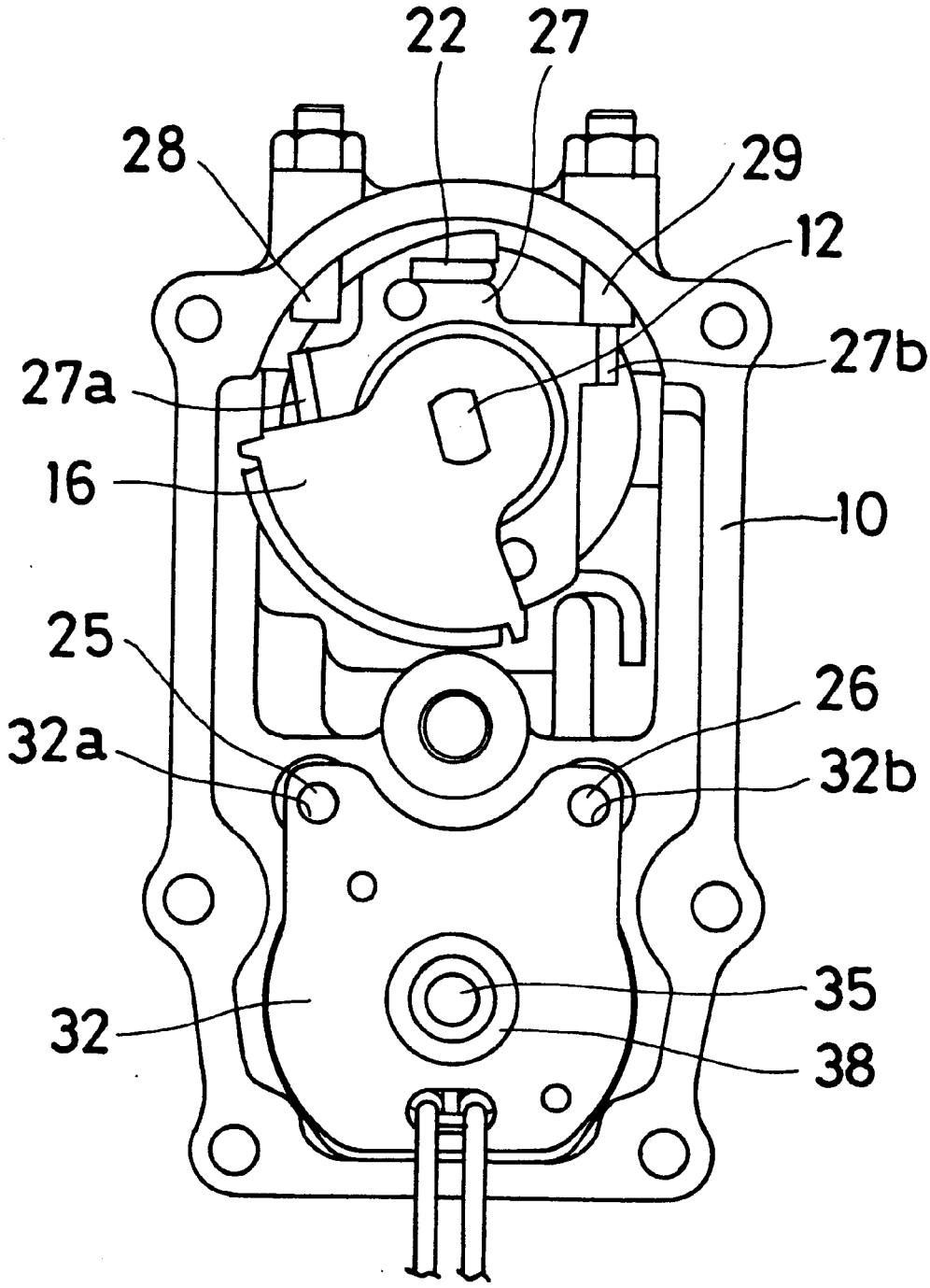
FIG. 4 is a side view similar to FIG. 3 in which the secondary gear is removed.

A first end 27*a* of the intermediate lever 27 is adapted to contact a complete closure stopper 28 as shown in FIGS. 3 and 4 to restrict the rotational position of the throttle valve 11 with respect to the closed side. A second end 27*b* of the intermediate lever 27 is adapted to contact a predetermined opening stopper 29 to define a rotational position for a predetermined valve opening. More specifically, when the intermediate lever 27 is turned together with the sector gear 16 (i.e., together with the throttle shaft 12) until the second end 27*b* of the intermediate lever 27 contacts the predetermined opening stopper 29, the throttle valve 11 fixed to the throttle shaft 12 provides a predetermined valve opening.

The throttle body 10 also contains a motor 30. In the motor 30, a plate 32 is fitted and fixed to a right-side end (as seen with reference to FIG. 2) of a housing 31 that serves as a yoke. The housing 31 is made of magnetic material. A rotor shaft 35 of the motor 30 is rotatably supported by a first bearing 33 fitted in the plate 32 and a second bearing 34 fitted in the left-side end portion of the housing 31 as seen with reference to FIG. 2. A rotor 36 that is fixed to the rotor shaft 35 is disposed in facing relation to magnets 37 that are adhered to the inner peripheral surface of the housing 31. Because the housing 31 and the plate 32 form the casing of the motor 30, the motor 30 can be individually subjected to a performance test or other type of procedure.

A pinion gear 38 that is fixed to a right-side end of the rotor shaft 35 (as seen with reference to FIG. 2) meshes with a secondary gear 18 that is journaled to the throttle body 10. The secondary gear 18 also meshes with the sector gear 16 that is fixed to the throttle shaft 12. The gear train defined by the pinion gear 38, the secondary gear 18 and the sector gear 16 form a drive force transmitting mechanism that is disposed on the right side of the throttle body 10 (as seen with reference to FIG. 2). This drive force transmitting mechanism is covered with a throttle body cover 19 that is fixed to the throttle body 10 by screws (not shown). In the thus-constructed throttle control apparatus, the motor 30 is driven to operate the throttle valve 11 by electric current that is set in accordance with the operation of an accelerator pedal by the driver. The amount of air flowing through the intake air passage 10*b* of the throttle body 10 is thereby controlled.

The positioning and fixing of the motor 30 to the throttle body 10 will now be described with reference to FIGS. 2, 3 and 4. A left-side outer peripheral edge 31*a* of the housing 31 (as seen with reference to FIG. 2) of the motor 30 is fitted in the throttle body 10 and is thus fixed in position in directions perpendicular to the rotor shaft 35 (i.e., in the radial and rotational directions). The plate 32 fitted to the right-side end of the housing 31 (as seen with reference to FIG. 2) has two positioning holes 32*a*, 32*b* as shown in FIG. 4. Positioning pins 25, 26 planted in the throttle body 10 are inserted into the positioning holes 32*a*, 32*b* of the plate 32, thereby fixing the plate 32 in position in directions perpendicular to the rotor shaft 35 (i.e., in the radial and rotational directions).

An elastic member in the form of a leaf spring 17 is disposed between the throttle body 10 and the left-side end surface 31*b* of the housing 31 of the motor 30 (as seen with reference to FIG. 2) to urge the housing 31 to the right in FIG. 2. Several protrusions 19*a* are formed on the inside surface of the throttle body cover 19 that covers the right side of the throttle body 10 (as seen with reference to FIG. 2). The protrusions 19*a* are formed at positions such that, as indicated by two-dot lines in FIG. 3, they do not interfere with the pinion gear 38 or the secondary gear 18 of the gear train. The protrusions, which are generally arc-shaped, are symmetrically positioned about the rotor shaft 35 that is fixed to the pinion gear 38. The distal ends of the protrusions 19*a* contact the right-side end surface 32*c* of the plate 32 of the motor 30 (as seen with reference to FIG. 2). The motor 30 is thereby fixed in position in directions parallel to the rotor shaft 35 (i.e., in the thrust directions).

The motor 30 is thus fixed in the throttle body 10 and positioned in directions perpendicular to the rotor shaft 35 (i.e., radial and rotational directions) and directions parallel to the rotor shaft 35 (i.e., thrust directions). The fixation between the housing 31 and the plate 32 fitted thereto becomes highly reliable when the throttle body cover 19 is screwed to the throttle body 10 after the motor 30 is fitted into the throttle body 10.

Because the casing of the motor 30, which is formed by the housing 31 and the plate 32, is separately provided solely for the motor 30 as described above, the magnets 37 of the motor 30 do not need to be pre-magnetized but can be magnetized after they are adhered to the inner peripheral surface of the housing 31. Therefore. difficulty in the assembly of the motor 30 caused by the magnets 37 attracting the rotor 36 can be eliminated.

Furthermore, because the motor 30 is positioned and fixed in the throttle body 10 in a loose fitting manner using only the opposite ends of the motor 30 (i.e., the left-side end surface 31*b* of the housing 31 and the right-side end surface 32*c* of the plate 32 as seen with reference to FIG. 2), the housing 31 serving as the yoke of the motor 31 is free from deformation or the like, thereby eliminating problems associated with the magnets 37 falling apart.

The above-described manner of fitting the motor 30 in the throttle body 10 also eliminates the problems typically arising in a case where the housing or the plate of the motor is fixed using screws. That is, the problems of increased space required for the screw connection and increased assembling man-hours due to torque control on the screws is eliminated. Moreover, because the motor 30 is provided as a separate unit, it is possible to test the performance of the motor 30 at an early stage prior to mounting in the throttle body 10, thereby avoiding an unnecessary increase in the assembling man-hours.

The electrical construction of the throttle control apparatus of this embodiment will be described with reference to FIG. 1. A throttle-controlling electric control unit (ECU) 50 receives inputs in the form of, for example, a throttle opening signal from the throttle sensor 20, an accelerator stroke signal from an accelerator sensor 40 for detecting the amount of depression of the accelerator pedal 41 by a driver, a brake signal A from a brake switch (not shown) actuated through operation of a brake pedal (not shown), and a vehicle speed signal B from a vehicle speed sensor (not shown). The throttle-controlling ECU 50 computes a predetermined instruction value based on the accelerator stroke signal from the accelerator sensor 40 for detecting the amount of depression of the accelerator pedal 41. A predetermined value of current based on this instruction value is supplied to the motor 30, thereby driving the motor 30. An internal combustion engine-controlling ECU 60 performs various controls on the internal combustion engine 70, such as fuel injection time control, ignition timing control, variable valve control and the like. A mutual monitoring relationship is established between the CPU in the throttle-controlling ECU 50, which constitutes a main CPU, and the CPU in the engine-controlling ECU 60, which constitutes a sub-CPU.

The processing procedure of the CPU of the throttle-controlling ECU 50 employed in the throttle control apparatus of the present invention is described below with reference to the flowchart of FIG. 5. The routine illustrated by the flowchart is repeatedly performed every predetermined length of time.

The CPU of the throttle-controlling ECU 50 first determines in step S101 whether there is an abnormality in the throttle system or device. In this throttle system abnormality determination, if the deviation between the value of current presently supplied to the motor 30 based on a predetermined instruction value and the value of the output from the throttle sensor 20 corresponding to the throttle opening of the throttle valve 11 exceeds a preset reference value, it is determined that a system abnormality has occurred. If the abnormality determination condition is not satisfied, meaning that the value of the current to the motor 30 is appropriate and so the throttle system is operating normally, this routine ends without performing any further processing.

Conversely, if it is determined in step S101 that the deviation between the current value to the motor 30 and the value of output from the throttle sensor 20 exceeds the preset reference value (i.e., the throttle system is operating abnormally), the operation proceeds to step S 102, where energization of the motor 30 is stopped. When energization of the motor 30 is stopped, the throttle shaft 12 is forced in the throttle valve opening direction and is fixed at the predetermined opening of the throttle valve 11 defined by the intermediate lever 27 contacting the predetermined opening stopper 29 because the force from the opener spring 22 via the intermediate lever 27 to urge the throttle shaft 12 in the opening direction is greater than the force of the return spring 21 that urges the throttle shaft 12 in the closing direction. Subsequently, the operation proceeds to step S103, where a throttle system failure signal TSF is turned to "1" and sent to the internal combustion engine-controlling ECU 60. At this moment, the throttle system failure warning lamp (not shown) is turned on to notify the driver of the failure.

The operation proceeds to step S104, where the CPU determines whether a throttle opening instruction value calculated from the accelerator stroke signal from the accelerator sensor 40 detecting the amount of depression of the accelerator pedal 41, exceeds a predetermined value. That is, the CPU determines whether, despite the throttle system failure, the driver is depressing the accelerator pedal 41 for an increased throttle opening to such an extent that the throttle opening instruction value based on the amount of depression of the accelerator pedal 41 exceeds a predetermined value (corresponding to, for example, about 100 km/h on a flat road, considering highway or uphill driving).

If the determination condition of step S104 is satisfied, it is considered that the accelerator pedal 41 is being depressed by an amount that exceeds a predetermined value, and the operation proceeds to step S105. In step S105, the accelerator signal SACC is turned to "1" and sent to the internal combustion engine-controlling ECU 60. Conversely, if the determination condition of step S104 is not satisfied, the operation proceeds to step S106, where the accelerator signal SACC is turned to "0" and sent to the internal combustion engine-controlling ECU 60. This routine subsequently ends.

The processing procedure of the CPU of the internal combustion engine-controlling ECU 60 employed in the throttle control apparatus of the present invention will be described with reference to the flowchart of FIG. 6. The routine illustrated in the flowchart is repeatedly performed every predetermined length of time.

The CPU of the internal combustion engine-controlling ECU 60 first determines in step S201 whether the throttle system failure signal TSF from the throttle-controlling ECU 50 is "1". If the determination condition of step S201 is not satisfied, that is if the throttle system failure signal TSF is "0" and, therefore, the throttle system is operating normally, the operation proceeds to step S202 where all-cylinder operation is performed using all the cylinders of the internal combustion engine (for example, six cylinders in the case of a six-cylinder engine). Conversely, if the determination condition of step S201 is satisfied, that is if the throttle system failure signal TSF is "1", which indicates that the throttle system is operating abnormally, the operation proceeds to step S203 where the CPU determines whether the accelerator signal SACC from the throttle-controlling ECU 50 is "1". If the determination condition of step S203 is satisfied, which indicates that despite a throttle system failure, the driver nevertheless desires high speed operation of the internal combustion engine, the engine operation using all the cylinders is continued with the throttle opening fixed to the predetermined opening corresponding to the aforementioned predetermined value. The routine subsequently ends.

If the determination condition of step S203 is not satisfied, that is if the accelerator signal SACC from the throttle-controlling ECU 50 is "0", the operation proceeds to step S204. In step S204, it is determined whether the present engine speed Ne is greater than a predetermined engine speed needed to maintain a vehicle speed of about 100 km/h on a flat road. If the determination condition of step S204 is satisfied, that is in the situation where there is a throttle system failure and the driver desires low speed operation of the internal combustion engine as evidenced by depression of the accelerator pedal, and the engine speed Ne is not greater than the predetermined engine speed, the operation proceeds to step S205. In step S205, reduced-cylinder operation is performed using a predetermined number of cylinders of the internal combustion engine (for example, three cylinders in the case of a six-cylinder engine, or two cylinders in the case of a four-cylinder engine). Conversely, if the determination condition of step S204 is satisfied, that is in a situation where there is a throttle system failure, and the driver desires low speed operation of the internal combustion engine as evidenced by depression of the accelerator pedal, but the engine speed Ne is greater than the predetermined engine speed, the operation proceeds to step S206. In step S206, all cylinder rest processing is performed where all the cylinders of the internal combustion engine are put into a resting state.

As described above, the throttle control apparatus of this embodiment includes: the throttle valve 11 for regulating the amount of air flowing through the intake air passage of the internal combustion engine 70; a throttle control device realized by the throttle-controlling ECU 50 for driving the motor 30 in accordance with a predetermined throttle opening instruction value based on various information to thereby control the opening of the throttle valve 11; the throttle sensor 20 for detecting the opening of the throttle valve 11; a determination device constituted by the throttle-controlling ECU 50 for determining whether there is a system abnormality based on a comparison of the deviation between the predetermined throttle opening instruction value and the value of the output from the throttle sensor 20 with respect to a preset reference value; a valve opening fixation mechanism, constituted by the throttle-controlling ECU 50, the return spring 21, the opener spring 22, the intermediate lever 27 and the predetermined opening stopper 29, which fixes the throttle valve 11 at a predetermined opening if the determination device determines that there is a system abnormality; and an output adjusting device constituted by the internal combustion engine-controlling ECU 60 for varying the output of the internal combustion engine 70 while the opening of throttle valve 11 is fixed.

According to the present invention, the motor 30 is driven by a current value, that is a throttle opening instruction value, calculated by the throttle-controlling ECU 50 on the basis of various information that includes the accelerator stroke signal from the accelerator sensor 40 to operate the throttle valve 11. The throttle-controlling ECU 50 determines that there is a system abnormality if the deviation between the current value and the value of the output from the throttle sensor 20 exceeds the preset reference value. If it is determined that there is a system failure, the throttle-controlling ECU 50 discontinues energization of the motor 30 so that the throttle valve 11 is fixed at a predetermined opening defined by the abutment of the intermediate lever 27 on the predetermined opening stopper 29 achieved by the urging force of the opener spring 22 that overcomes the urging force of the return spring 21. While the fixed valve opening is maintained, the internal combustion engine-controlling ECU 60 varies the output of the internal combustion engine 70. Therefore, even if a throttle system failure occurs, the vehicle is still able to run so that driving of the vehicle according to the driver's intention is possible even during the failure.

The various information fed to and used by the throttle control apparatus includes the accelerator stroke signal from the accelerator sensor 40 indicating the amount of depression of the accelerator pedal 41, the brake signal indicating operation of the brake pedal, or a signal based on a preset condition. Therefore, the throttle-controlling ECU 50 is able to calculate a throttle opening instruction value from not only the accelerator stroke signal based on the amount of depression of the accelerator pedal 41 or the brake signal based on the operation of the brake pedal, but also a signal based on a preset condition, for example a signal from a cruise control. i.e., a constant-speed vehicle running mechanism for maintaining a constant vehicle speed). Therefore, the throttle control apparatus is applicable to various systems independent of the amount of depression of the accelerator pedal 41 or brake pedal operation.

Furthermore, in the throttle control apparatus according to the present invention, the output adjustment device in the form of the internal combustion engine-controlling ECU 60 varies the number of cylinders of the internal combustion engine 70 that are operated, on the basis of the accelerator stroke signal from the accelerator sensor 40. Therefore, because the output of the internal combustion engine can be varied on the basis of the accelerator stroke signal from the accelerator sensor based on the amount of depression of the accelerator pedal 41 even during a throttle system failure, the throttle control apparatus enables vehicle driving that reflects driver's intention.

Although, in the foregoing embodiment, the throttle system abnormality determination is based on the value of current fed to the motor 30, the present invention is not restricted by this determination manner. According to the present invention, it is also possible to determine that there is a system abnormality if the throttle opening signal from the throttle sensor 20 does not change in a predetermined manner in response to a predetermined value of current to the motor 30.

Furthermore, although the accelerator signal SACC is set to "1" or "0" based on the comparison of the throttle opening instruction value calculated from the accelerator stroke signal from the accelerator sensor 40 detecting the amount of depression of the accelerator pedal 41 with a single predetermined value, the present invention is not restricted in this way. It is also possible according to the invention to set a plurality of predetermined values for such comparison so as to vary the output of the internal combustion engine in finer increments.

Further, although, in the foregoing embodiment, the output of the internal combustion engine is varied by reducing the number of cylinders in operation, the present invention is not restricted by this output varying manner. It is also possible according to the invention to vary the output of the internal combustion engine by employing fuel injection time control, ignition timing control, variable valve control for varying the opening or closing timing of an intake valve, or other related ways, or a combination of any of these measures.

The principles, a preferred embodiment and the mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A throttle control apparatus comprising:

a throttle valve for regulating air flow in an intake passage of an internal combustion engine;

throttle control means for controlling opening of the throttle valve through operation of a motor according to a predetermined instruction value based on various information;

a throttle sensor for detecting opening of the throttle valve;

determination means for determining whether there is a system abnormality by comparing with a preset reference value a deviation between the predetermined instruction value and an output value from the throttle sensor;

a valve opening fixation mechanism for fixing the opening of the throttle valve to a predetermined opening when the determination means determines the existence of a system abnormality; and output adjustment means for varying output of the internal combustion engine when the opening of the throttle valve is fixed by the valve opening fixation mechanism.

2. A throttle control apparatus according to claim 1, wherein the various information includes one of a signal based on an amount of depression of an accelerator pedal, a signal based on operation of a brake pedal, and a signal based on a preset condition.

3. A throttle control apparatus according to claim 1, wherein the output adjustment means varies number of cylinders being active in operation of the internal combustion engine, on the basis of the various pieces of information.

4. A throttle control apparatus according to claim 1, wherein the output adjustment means varies the output of the internal combustion engine by varying a number of cylinders of the internal combustion engine that are operational.

5. A throttle control apparatus comprising:

a throttle valve device including a throttle valve for regulating air flow in an intake passage of an internal combustion engine;

a motor connected to the throttle valve for opening the throttle valve;

throttle control means for controlling opening of the throttle valve through operation of the motor;

determination means for determining whether there is an abnormality in the throttle valve device;

a valve opening fixation mechanism for fixing the throttle valve at a predetermined opening when the determination means determines the existence of an abnormality in the throttle valve device; and output adjustment means for varying output of the internal combustion engine when the determination means determines the existence of an abnormality in the throttle valve device and when the opening of the throttle valve is fixed by the valve opening fixation mechanism.

6. A throttle control apparatus according to claim 5, including an accelerator sensor for detecting an amount of depression of an accelerator pedal, and means for comparing a signal outputted by said accelerator sensor indicating the amount of depression of the accelerator pedal with a predetermined value.

7. A throttle control apparatus according to claim 6, wherein said output adjustment means varies the output of the internal combustion engine when the means for comparing determines that the amount of depression of the accelerator pedal is less than the predetermined value.

8. A throttle control apparatus according to claim 5, including a throttle valve sensor for detecting the opening of the throttle valve and for producing an output based on the opening of the throttle valve, the throttle control means controlling the opening of the throttle valve according to a predetermined instruction value.

9. A throttle control apparatus according to claim 8, wherein said determination means determines that an abnormality in the throttle valve device exists by comparing with a preset reference value a difference between the predetermined instruction value and the output from the throttle valve sensor.

10. A throttle control apparatus according to claim 5, wherein said throttle valve is mounted on a throttle shaft, said valve opening fixation mechanism including an intermediate lever operatively connected to the throttle shaft and a spring operatively connected to the intermediate lever for urging one end of the intermediate lever towards a stopper, the spring urging the one end of the intermediate lever into contacting relation with the stopper when the determination means determines the existence of an abnormality in the throttle valve device.

11. A throttle control apparatus comprising:

a throttle valve device including a throttle valve for regulating air flow in an intake passage of an internal combustion engine;

a motor connected to the throttle valve device for opening the throttle valve;

determination means for determining whether there exists an abnormality in the throttle valve device;

a throttle control unit connected to the motor and the determination means for stopping operation of the motor when the determination means determines there is an abnormality in the throttle valve device;

a valve opening fixation mechanism for fixing the throttle valve at a predetermined open position when the throttle control unit stops operation of the motor due to a determination by the determination means that there is an abnormality in the throttle valve device; and an engine control unit which varies output of the internal combustion engine when the determination means determines the existence of an abnormality in the throttle valve device and when the opening of the throttle valve is fixed at the predetermined position by the valve opening fixation mechanism.

12. A throttle control apparatus according to claim 11, including an accelerator sensor for detecting an amount of depression of an accelerator pedal, and means for comparing a signal outputted by said accelerator sensor indicating the amount of depression of the accelerator pedal with a predetermined value.

13. A throttle control apparatus according to claim 12, wherein said engine control unit varies the output of the internal combustion engine when the means for comparing determines that the amount of depression of the accelerator pedal is less than the predetermined value.

14. A throttle control apparatus according to claim 12, including a throttle valve sensor for detecting the opening of the throttle valve and for producing an output based on the opening of the throttle valve, and a throttle control means operatively connected to the throttle valve for controlling the opening of the throttle valve according to a predetermined instruction value.

15. A throttle control apparatus according to claim 14, wherein said determination means determines that an abnormality in the throttle valve device exists by comparing with a preset reference value a difference between the predetermined instruction value and the output from the throttle valve sensor.

16. A throttle control apparatus according to claim 11, including a throttle valve sensor for detecting the opening of the throttle valve and for producing an output based on the opening of the throttle valve, and a throttle control means operatively connected to the throttle valve device for controlling the opening of the throttle valve device according to a predetermined instruction value.

17. A throttle control apparatus according to claim 11, wherein said throttle valve is mounted on a throttle shaft, said valve opening fixation mechanism including an intermediate lever operatively connected to the throttle shaft and a spring operatively connected to the intermediate lever for urging one end of the intermediate lever towards a stopper, the spring urging the one end of the intermediate lever into contacting relation with the stopper when the throttle control unit stops operation of the motor due to the determination means determining the existence of an abnormality in the throttle valve device.

* * * * *